US011787076B2

(12) United States Patent
Staudinger et al.

(10) Patent No.: US 11,787,076 B2
(45) Date of Patent: Oct. 17, 2023

(54) PUNCHING/PERFORATION MACHINE

(71) Applicant: WISTA Werkzeugfertigungs-GmbH, Bad Rappenau (DE)

(72) Inventors: Gerd Staudinger, Eppingen (DE); Alexander Fuchs, Sinsheim (DE)

(73) Assignee: WISTA Werkzeugfertigungs-GmbH, Bad Rappenau (DE)

( * ) Notice: Subject to any disclaimer, the term of this patent is extended or adjusted under 35 U.S.C. 154(b) by 135 days.

(21) Appl. No.: 17/601,124

(22) PCT Filed: Apr. 1, 2020

(86) PCT No.: PCT/DE2020/000072
§ 371 (c)(1),
(2) Date: Nov. 22, 2021

(87) PCT Pub. No.: WO2020/200346
PCT Pub. Date: Oct. 8, 2020

(65) Prior Publication Data

US 2022/0111545 A1 Apr. 14, 2022

(30) Foreign Application Priority Data

Apr. 5, 2019 (DE) ..... 20 2019 001 573.6

(51) Int. Cl.
*B26D 5/12* (2006.01)
*B26F 1/04* (2006.01)
(Continued)

(52) U.S. Cl.
CPC ..... *B26D 5/12* (2013.01); *B26F 1/04* (2013.01); *B26F 1/24* (2013.01); *B26D 2005/002* (2013.01)

(58) Field of Classification Search
CPC ..... B26D 5/12; B26D 2005/002
(Continued)

(56) References Cited

U.S. PATENT DOCUMENTS 3,237,242 A * 3/1966 Gerletz ..... B29C 51/445 226/162
5,204,913 A * 4/1993 Morooka ..... B26D 5/007 382/296
(Continued)

FOREIGN PATENT DOCUMENTS

DE 3339503 A1 5/1985
DE 4135787 A1 5/1992
(Continued)

OTHER PUBLICATIONS

Gerd Staudinger et al., co-pending U.S. Appl. No. 17/601,097, filed Oct. 4, 2021.

*Primary Examiner* — Omar Flores Sanchez
(74) *Attorney, Agent, or Firm* — Smartpat PLC

(57) ABSTRACT

A punching/perforation machine for creating a punching/perforation pattern in a material unit/web comprises a punching/perforation tool that includes an upper tool part which can be moved in a direction of stroke and which includes a plurality of punching dies/perforation needles arranged in a predefined grid in a transverse direction. It can be moved by a pressure beam that is operatively connected to a drive unit via a control device in order to produce a punching/perforation stroke. The material unit/web being supplied between the upper tool part and a stationary lower tool part/female die. Means are provided for generating a simultaneous movement of the material unit/web relative to the punching/perforation tool by a predefinable distance both in the direction of travel and in the transverse direction such that the material unit/web can be placed in a different predefinable position relative to the punching/perforation tool prior to each punching/perforation stroke.

8 Claims, 3 Drawing Sheets

(51) Int. Cl.
*B26F 1/24* (2006.01)
*B26D 5/00* (2006.01)

(58) Field of Classification Search
USPC ..... 83/76.1
See application file for complete search history.

(56) References Cited

U.S. PATENT DOCUMENTS

| | | | | | |
|---|---|---|---|---|---|
| 5,357,446 | A * | 10/1994 | Maeda | B21D 28/26 | 700/182 |
| 6,062,120 | A * | 5/2000 | Tsuzaki | B26D 9/00 | 83/687 |
| 6,951,177 | B2 * | 10/2005 | Fischer | D05B 3/08 | 112/68 |
| 7,065,478 | B2 * | 6/2006 | Liu | G06F 30/17 | 703/7 |
| 2003/0226486 | A1 * | 12/2003 | Filges | D05B 37/04 | 112/65 |
| 2014/0298968 | A1 * | 10/2014 | Hirosawa | H01L 21/78 | 83/39 |

FOREIGN PATENT DOCUMENTS

| | | | |
|---|---|---|---|
| DE | 202005010990 | U1 | 9/2005 |
| DE | 202014104997 | U1 | 12/2014 |
| DE | 202017103498 | U1 | 7/2017 |
| DE | 202019000468 | U1 | 2/2019 |
| JP | 2002355796 | A | 12/2002 |
| WO | 2019202637 | A1 | 10/2019 |

* cited by examiner

PUNCHING/PERFORATION MACHINE

TECHNICAL FIELD

The present disclosure relates to a punching/perforating machine for generating a predefinable punching/perforation pattern in a material unit/web.

BACKGROUND

DE 33 39 503 A1 discloses a punching machine having a plurality of stamping punches, which each interact with a female die, a drive device for the stamping punch movements and a feed device for moving the material to be punched cyclically onward through the punching machine. In at least one of the stamping punches, preferably in all of the stamping punches, an individual drive that can be switched on and off and/or a coupling to the drive device that can be switched on and off is provided. The punching machine furthermore comprises a machine table having a plurality of receiving positions for a respective tool unit. The tool unit has at least one female die and at least one stamping punch which can be acted on by the drive device. The tool unit comprising the female die and a stamping punch interacting with the female die comprises an individual drive that can be switched on and off or a coupling device that can be switched on and off for the transmission of the stamping punch drive force.

DE 41 35 787 A1 describes a punch processing apparatus for producing a punching pattern, comprising an upper die with a stamping punch holder having a plurality of stamping punches and with a stripper plate located underneath with holes for receiving the ends of the stamping punches projecting from the stamping punch holder, in such a way that they can be extended or retracted, and a lower die with holes into which the ends of the stamping punches enter during the punching operation. Feed devices move a material unit, which is introduced between the lower die and the stripper plate, intermittently and synchronously with the punching operation. The stamping punches are retained in the stamping punch holder such that they can be moved upward and downward, wherein the upper sides of heads of the stamping punches end smoothly or with the upper surface of the stamping punch holder. In this case, press heads are used with a head surface for pressing down the stamping punch heads. In addition, a stepped portion preventing pressing down is movable by press head drive devices in such a way that either the head surface or the blunted portion is aligned with the respective stamping punch head. The press head drive devices are controlled by a control circuit, which generates binary-coded processing data according to the punching pattern.

German utility model specification DE 20 2005 010 990 U1 describes an apparatus for punching workpieces, comprising an upper tool and a lower tool, wherein the upper tool is movable relative to the lower tool, wherein a plurality of stamping punches and actuating elements assigned thereto are arranged in the upper tool and are adjustable between an actuating position, in which the stamping punches process the workpiece during a movement of the upper tool relative to the lower tool, and a not actuating position, in which the stamping punches do not process the workpiece during a movement of the upper tool relative to the lower tool, and wherein the upper tool comprises a first, upper punch guide plate with holes for the punches to be guided through and a second punch guide plate, facing the lower tool, with holes for the punches to be guided through. Furthermore, a second punch guide plate, facing the lower tool, of the upper tool is part of a hold-down element, wherein the friction of the stamping punches within the holes of the hold-down element is higher than within the holes of the upper punch guide plates of the upper tool.

German utility model specification DE 20 2017 103 498 U1 discloses a perforating machine comprising a machine table and a striking element which is movable relative thereto, comprising a perforating tool, which is accommodated either on the machine table or on the striking element and which is assigned a female die on the respective other part, for perforation of a material web that is guided such that it can be driven in its longitudinal direction between the perforating tool and the female die. Additionally provided are means for the simultaneous movement of the perforating tool and the female die in the transverse direction relative to the material web.

German utility model specification DE 20 2014 104 997 U1 describes a punch having a plurality of stamping punches, the punch heads of which are mounted in a punch receiving plate. The mounting of the punch heads in the punch receiving plate is designed in such a way that an undercut is produced during the reverse stroke of the stamping punches, wherein a drive element moves the punch receiving plate indirectly. The punch has at least one locking element, which is assigned to at least one stamping punch and is located between the drive element and the punch receiving plate. The locking element is movable into two operating positions, wherein, in a first operating position, the locking element fills the interspace between the drive element and the punch head of the at least one stamping punch and, in a second operating position, the locking element forms a clearance above the punch head of the at least one stamping punch and wherein, in addition, the at least one stamping punch is retained by a braking element, at least in the second operating position of the locking element.

Furthermore, in the known punching/perforating machines, the spacing between the stamping punches/perforating needles is relatively large on account of the selected geometry, such that punching/perforation patterns with a small grid size cannot be generated.

The number of needles in the known punching/perforating machines is therefore significantly limited per unit area.

Furthermore, it should be noted with respect to the known punching/perforating machines that the cycle rate with respect to the punching/perforation strokes to be carried out is relatively low on account of the mechanically selected designs, which increases the processing time in the production process. This has a negative effect on the economical use of such punching/perforating machines.

German utility model DE 20 2019 000 468 discloses a punching/perforating machine which is equipped with the following features, namely a punching/perforation tool having a plurality of stamping punches/perforating needles which are arranged in a predefined grid in a longitudinal direction and which are movable by means of a pressure beam which is operatively connected via a control device to a drive unit for generating a punching/perforation stroke transversely to the longitudinal direction, a control block for actuation/activation/deactivation of the stamping punches/perforating needles by the control device during the punching/perforating operation, and distinguished in that the punching/perforation tool and/or the control block is/are in each case formed as a separate subassembly, which is/are in each case arranged within the punching/perforating machine so as to be removably fastenable separately as a unit. In this punching/perforating machine, the material unit/web is cyclically supplied in the transport direction prior to each punching/perforation stroke and the punching or perforation is carried out, wherein the individual stamping punches/perforating needles to be activated per stroke for the punching/perforating operation can be individually activated or deactivated. On account of the cyclic supply of the material unit/web, the possible perforation patterns are predetermined by the design specifications of this machine.

SUMMARY

The present disclosure is based on the object or the technical problem of specifying a punching/perforating machine of the type mentioned in the introduction which ensures high variability with respect to a possible punching/perforation pattern, guarantees high cycle rates, ensures permanently reliable functioning and enables high service lives.

The punching/perforating machine according to the invention is provided by the features of independent claim 1. Advantageous refinements and developments are the subject matter of the claims which are directly or indirectly dependent on independent claim 1.

The punching/perforating machine for generating a predefinable punching/perforation pattern in a material unit/web supplied in a transport direction, comprises a punching/perforation tool having a tool upper part, which is movable in a stroke direction and which has a plurality of stamping punches/perforating needles which are arranged in a predefined grid in a transverse direction and which are movable by means of a pressure beam which is operatively connected via a control device to a drive unit for generating a punching/perforation stroke, and a stationary tool lower part/female die. The material unit/web is supplied between the tool upper part and the tool lower part.

The punching/perforating machine is distinguished in that means for generating a simultaneous relative movement of the material unit/web relative to the punching/perforation tool to a predefinable extent both in the transport direction and in the transverse direction are present, such that the material unit/web is positionable, prior to each punching/perforation stroke, in an individual predefinable position relative to the perforation tool.

By virtue of the fact that the means for generating a simultaneous relative movement of the material unit/web can be used to bring the material unit/web into any desired predefinable position prior to the perforating operation, a wide variety of different punching/perforation patterns which are not possible with the hitherto known punching/perforating machines can be made possible, wherein at the same time a high cycle rate and permanently reliable functioning can be ensured.

In contrast to the machines known in the prior art, it is not the punching/perforation tool that is displaced but rather merely the material unit/web or the receiving unit thereof, which requires considerably lower forces, thus permits faster cycle rates and prevents increased wear.

A particularly preferred refinement of the punching/perforating machine is distinguished in that the means comprise a first drive unit, which brings about a movement of the material unit/web in the transport direction, and a second drive unit, which brings about the movement of the material unit/web in the transverse direction.

A particularly advantageous development, which ensures economical production while simultaneously ensuring permanently reliable functionality and service life, is distinguished in that the first drive unit and the second drive unit are each formed as a servomotor.

A reliably advantageous refinement which is particularly simple in terms of design is distinguished in that the drive units are connected via coupling members to the material unit/web.

An advantageous refinement is distinguished in that a memory device is present, in which the data for the geometry of the punching/perforation pattern with respect to position and diameter is stored, the control device is communicatively connected to the memory device, the control device is operatively connected to a control block of the stamping punches/perforating needles for actuation/activation/deactivation of the stamping punches/perforating needles during the punching/perforating operation, the control device is communicatively connected to the means for generating a simultaneous relative movement of the material unit/web and the control device initiates the corresponding activation of the means in dependence on the data stored in the memory device.

With regard to the variation of the design of the visual appearance of the punching/perforation pattern, a particularly advantageous refinement is distinguished in that the punching/perforation tool comprises stamping punches/perforating needles having different diameters.

A refinement which is particularly advantageous in terms of design, and which permits high cycle rates and at the same time permits individual configuration of the punching/perforation pattern, is distinguished in that a control block is present, which comprises piston-cylinder units whose movements during the punching/perforation stroke are individually actuable via the control device and are individually assigned to each stamping punch/each perforating needle, a blocking slide, which is connected in each case to a corresponding piston rod of the piston-cylinder unit, wherein the blocking slide is displaceable into an activation or deactivation position by the movement of the piston rod, in the activation position, the blocking slide acts directly or indirectly on the stamping punch/the perforating needle during the execution of the stroke, in the deactivation position, the blocking slide does not exert any action on the stamping punch/the perforating needle, such that, in the activation position of the blocking slide, the latter acts on the stamping punch/perforating needle during the stroke movement and a perforation is carried out and, in the deactivation position of the blocking slide, no punching/perforation of the material unit/web is effected.

According to a preferred development, it has proven to be particularly advantageous for the punching/perforating machine to be designed such that the piston-cylinder unit is formed as a double-acting piston-cylinder unit having a first pressure chamber and a second pressure chamber, wherein a first pressure is applied permanently to the first pressure chamber via the control device and has the effect that the blocking slide is located or retained in the deactivation position and, when carrying out punching or perforation, the control device applies a second pressure, which is higher than the first pressure, to the second pressure chamber when activated, such that the blocking slide moves out into the activation position and, as a result, during the stroke movement, this movement is transmitted to the associated stamping punch/perforating needle, such that punching or perforation of the material unit/web is carried out.

As a function of the system, only fixed predefined grids with respect to the punching/perforation pattern are possible as a result of the mechanical structure of known punching/perforating machines. By virtue of the fact that the material unit/web can be positioned in different directions relative to the punching/perforation tool, possibilities are opened up to implement perforation patterns that have hitherto not been possible. This results in a virtually unlimited representation of punching/perforation patterns desired in terms of design. Proceeding from the hitherto developed parts for controlling the pattern of the punching/perforating machine, the means for carrying out the movement of the material unit/web can be readily incorporated. This applies not only to individual material units/webs to be perforated but also during the perforation of roll goods, wherein the complete transport of the material to be perforated in the transport direction and in the transverse direction is correspondingly implemented by the movement means in conjunction with the control device and memory device. Furthermore, there is the possibility of carrying out punching using different punches or perforating needles having different diameters in the same work step. The punches/perforating needles of different diameter are only actuated or activated according to the actuation signals of the control device in relation to the desired pattern image.

Further embodiments and advantages of the invention emerge from the features further listed in the claims and also from the exemplary embodiments specified below. The features of the claims may be combined with one another in any desired way, provided they are not obviously mutually exclusive.

BRIEF DESCRIPTION OF THE DRAWINGS

The invention and advantageous embodiments and developments thereof are described and explained in more detail below on the basis of the examples illustrated in the drawing. The features apparent from the description and the drawing may be applied individually on their own or multiply in any desired combination. In the drawing.

DETAILED DESCRIPTION

Figure 2:
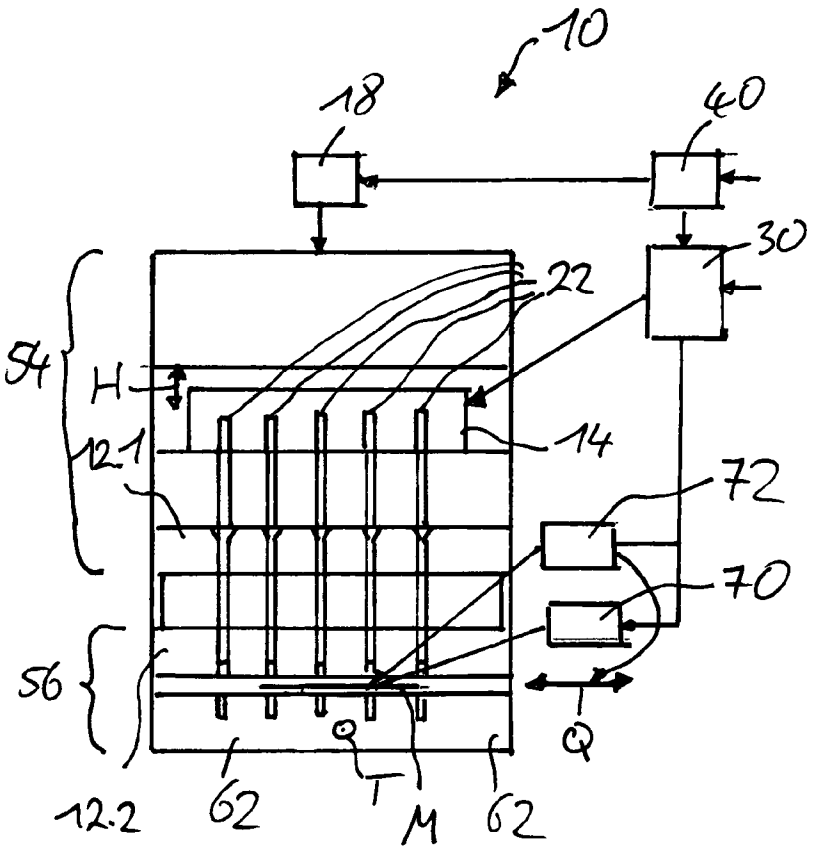
FIG. 2 shows a highly schematized illustration of a punching/perforating machine, as per FIG. 1, in a view as seen in the transport direction.
Figure 1:
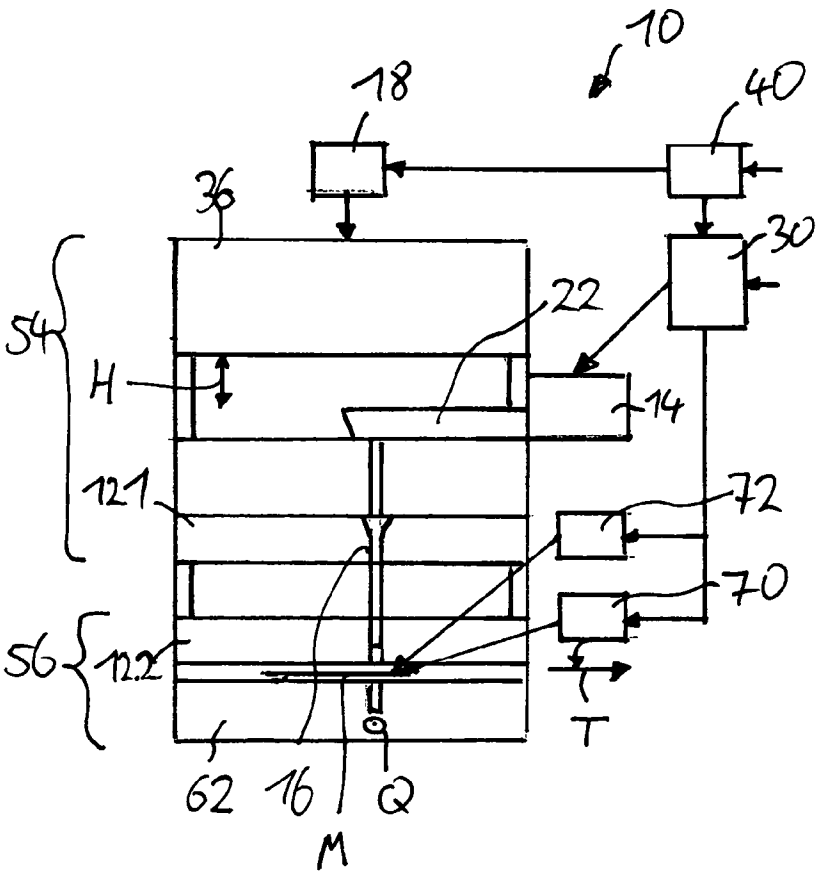
FIG. 1 shows a highly schematized illustration of a punching/perforating machine with means for displacing the material unit/web in the transport direction and/or transverse direction in a view as seen in the transverse direction.

A punching/perforating machine 10, which is illustrated in highly schematized form as an exemplary embodiment in FIGS. 1 and 2, comprises a machine upper part 54 and a machine lower part 56. In the machine upper part 54, a pressure beam 36 which is acted on by a drive unit 18 for generation of a punching/perforation stroke H is arranged on the top side. Below the pressure beam 36, and spaced apart, is a tool upper part 12.1 of a punching/perforation tool 12, in which stamping punches/perforating needles 16 are arranged.

Present between the pressure beam 36 and the punching/perforation tool 12 are blocking slides 22 which are connected to a control block 14. The blocking slides 22 are of extendable and retractable form and assigned in each case to a stamping punch or a perforating needle 16. In the extended state, as illustrated in FIG. 1, the associated stamping punch/perforating needle 16 is activated, such that a supplied material unit/web M is perforated during execution of the punching/perforation stroke H.

The machine lower part 56 comprises, on the top side, a tool lower part 12.2 of the punching/perforation tool 12, in which the stamping punch/the perforating needle 16 are guided, for example. Spaced apart on the bottom side is a base plate 62. The material unit/web M is supplied between the tool lower part 12.2 of the punching/perforation tool 12 and the base plate 62. The transport direction of the material unit/web M is denoted in FIG. 1 by the reference designation T.

Furthermore, a memory device 40 is present, in which all the data concerning the geometry of the patterns to be perforated or to be punched in the material unit/web M is stored, such as for example position and diameter of the perforation/punching apertures. The memory device 40 is communicatively connected to a control device 30, wherein the control device 30 actuates the punching/perforating machine 10 in dependence on the data stored in the memory device 40. For instance, the control device activates the drive unit 18 for activation of the punching/perforation stroke H. Furthermore, the control device 30 is communicatively connected to a first drive unit 70 and a second drive unit 72. The first drive unit 70 acts on the material unit/web M, in such a way that when the first drive unit 70 is activated, the material unit/web M carries out a movement in the transport direction T to a predefinable extent. Furthermore, the second drive unit 72 also acts on the material unit/web M, in such a way that when the second drive unit 72 is activated, the material unit/web M carries out a displacement in the transverse direction Q (see FIG. 2) to a predefinable extent. The activation of the displacement of the material unit/web M prior to each punching/perforation stroke H is initiated by the control device 30, which uses information retrieved from the memory device 40 as a basis for determining the extent of the displacement of the material unit/web M in the transport direction T and/or in the transverse direction Q for the respective punching/perforation stroke H.

Figure 3:
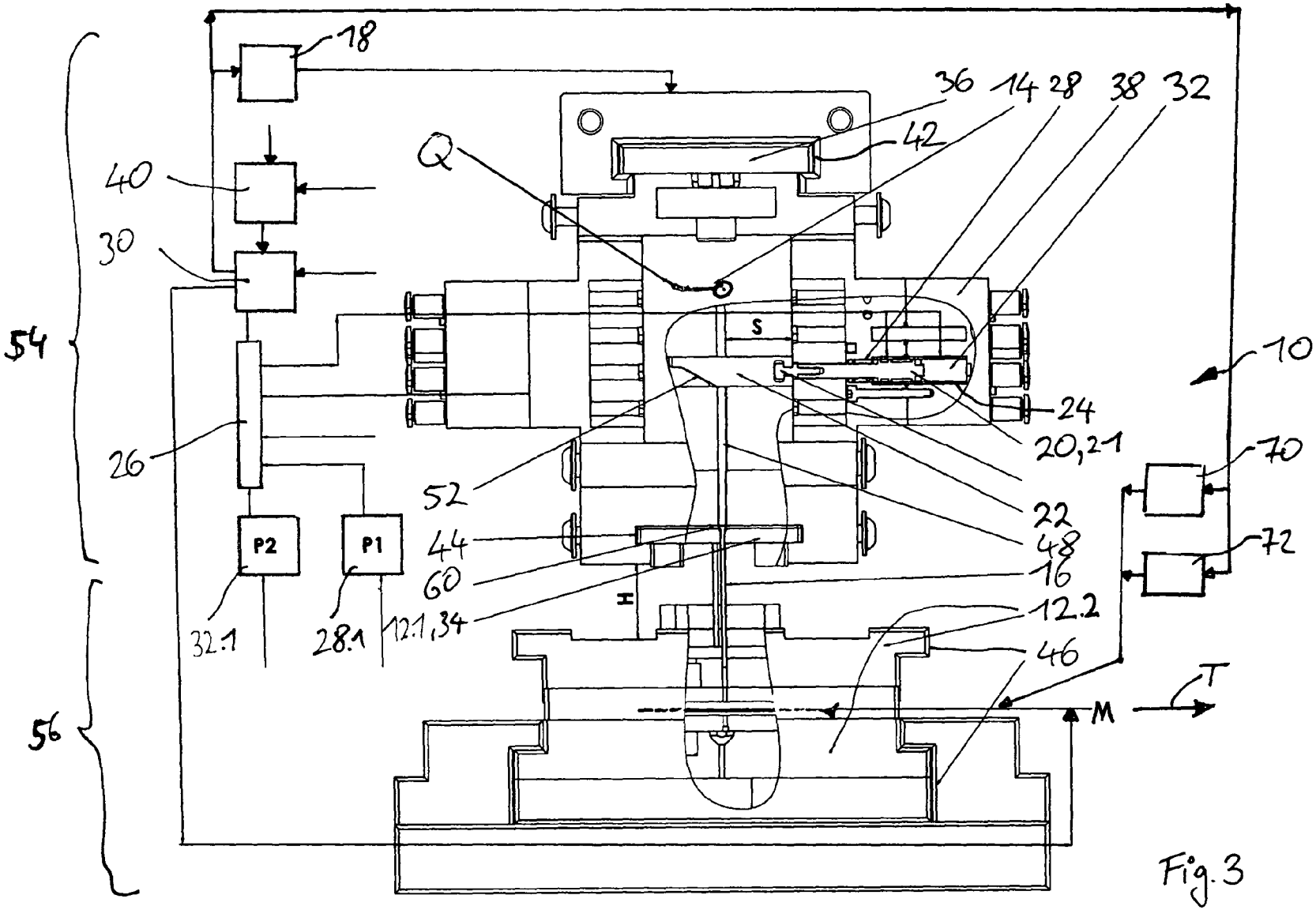
FIG. 3 shows a highly schematized illustration of a punching/perforating machine, as per FIG. 1, with additionally illustrated design details.

The punching/perforating machine 10 illustrated in schematized form in FIG. 3 represents an exemplary design embodiment—also partially in a highly schematized illustration—of the punching/perforating machine 10 as per FIGS. 1 and 2. Identical components bear the same reference designations and are not explained again.

The punching/perforating machine 10 comprises a punching/perforation tool 12 with a tool upper part 12.1, a tool lower part 12.2 and a control block 14. In the punching/perforating machine 10 which is driven by a servo-hydraulic system, the control block 14 is connected to a pressure beam 36, that is to say introduced in a control block guide groove 42 present on the pressure beam 36 and centered. A drive unit 18 moves the pressure beam 36 upward and downward in the stroke direction H. Located under the control block 14 is the corresponding tool upper part 12.1 of the punching/perforation tool 12, said tool upper part having a grid arrangement for the perforating needles 16 that is identical to that of the control block. The tool upper part 12.1 of the punching/perforation tool 12 comprises a needle holder 34 which is introduced in a needle holder guide groove 44 in the control block. The tool lower part 12.2 of the punching/perforation tool 12 having the female dies is centered by means of a centering pin (not illustrated in any more detail). This tool lower part 12.2 of the punching/perforation tool 12 is also placed in a tool guide groove 46. The needle holder 34 forms, together with the needle guide which is fixedly connected to the punching/perforation tool 12, a unit, namely the punching/perforation tool 12.

Located on the needle holder 34 is a spacer plate 60 which, firstly, facilitates the disassembly of the punching/perforation tool 12 and, secondly, permits the use of further standard tools with the same tool profile but different pitch. Here, the open spacer plate 60, which is provided with grid holes, is replaced by a closed variant without grid holes.

The perforating needles 16 are arranged in a predefined grid in the transverse direction Q, which runs perpendicularly to the plane of the illustration of FIG. 3. The perforating needles 16 can either be activated or deactivated individually during each punching/perforation stroke H. This individual actuation is implemented in that a control device 30 is present, which is communicatively connected to a memory device 40 in which the geometrical data of the punching/perforation pattern to be created on a material unit/web M supplied to the punching/perforation tool 12 is stored.

The control device 30 is communicatively connected to a valve device 26, wherein the valve device 26 comprises valve units which are each individually communicatively connected to piston-cylinder units arranged on the control block 14. The piston-cylinder units are formed as double-acting piston-cylinder units, having a cylinder 24, a piston 21 and a piston rod 20. A first pressure chamber 28 and a second pressure chamber 32 are present in each piston-cylinder unit.

Each piston rod 20 is connected, in its free end region, to a blocking slide 22, which is displaceable in the sliding direction S transversely to the stroke direction H from an activation position (extended state) and a deactivation position (retracted state) when corresponding pressure is applied to the piston-cylinder unit. Furthermore, a first pressure accumulator 28.1 and a second pressure accumulator 32.1 are present, which communicate with the valve device 26. The first pressure chamber 28 provides a pressure P1, and the second pressure chamber 32 provides a pressure P2, which is higher than the pressure P1.

Each perforating needle 16 is assigned a blocking slide 22 with associated actuable piston-cylinder unit. The blocking slide 22 is spaced apart from the upper head end of the perforating needle 16. Below the blocking slide 22, an extension profile 48 is present in the control block 14 in a corresponding guide, wherein the bottom side of the extension profile 48 bears on the head of the assigned perforating needle 16, and the upper end side of the extension profile 48 is arranged at the height level of the bottom side of the blocking slide 22. In the extended state of the blocking slide 22, the latter rests on the extension profile 48 such that when the stroke movement H of the control block 14 is carried out, the perforating needle 16 is moved downward and triggers a perforation on the material unit/web M.

In the case of a retracted blocking slide 22, there is no contact between the extension profile 48 and the blocking slide 22 since the bottom side of the blocking slide 22 is beside the bottom side of the extension profile 48. If a punching/perforation stroke is carried out in the retracted position of the blocking slide 22, the extension profile 48 has no movement applied to it by the blocking slide 22, such that the assigned perforating needle 16 does not carry out a perforation.

The blocking slide 22 has, in its free end region, a contour 52 which runs at an angle to the punching/perforation stroke direction H and which ensures that if the extension profile 48 or the perforating needle 16 protrudes upward when the blocking slide 22 is being extended, the extension profile 48 is pushed downward and is not sheared off or damaged. As a result, permanently reliable functionality is ensured.

During operation of the punching/perforating machine, the first pressure chamber 28 and second pressure chamber 32 are actuated individually as follows via the valve device 26 and the control device 30, taking account of the stored punching/perforation pattern data. The first pressure chamber 28 has the pressure P1 applied permanently via the first pressure accumulator 28.1, that is to say, under the action of the pressure P1, the blocking slide 22 is in the retracted position such that when the punching/perforation stroke H is carried out, the assigned perforating needle 16 does not carry out a perforation.

If a perforating needle 16 is to be activated during a punching/perforation stroke H, the control device 30 causes the valve device 26 to apply the pressure P2 to the second pressure chamber 32 via the second pressure accumulator 32.1, said pressure P2 being higher than the permanently present pressure P1 in the first pressure chamber 28, such that the blocking slide 22 moves out and, when the punching/perforation stroke H is carried out, the assigned perforating needle 16, in conjunction with the extension profile 48, carries out a punching/perforation stroke H and produces a perforation on the material unit/web M.

On the control block 14 there are thus individually actuated piston-cylinder units which are under a permanent first pressure P1 which, so to speak, forms an air spring on the return stroke, wherein for each perforating needle 16 to be actuated in the punching/perforation tool 12, a piston rod 20 of the corresponding piston-cylinder unit is assigned and is activated, that is to say extended, by application of the pressure P2.

As a result of the mutually separated structure of control block 14 and punching/perforation tool 12 in conjunction with the piston-cylinder units arranged offset in the stroke direction H and in the transverse direction Q within a housing 38, it is possible to achieve a minimum spacing with respect to the grid size between the perforating needles 16 in the tool 12, which corresponds for example to a standard perforation in automobile construction. From this, for example a maximum number of 1024 needles with a perforation width of 1.9456 mm can be achieved.

This high number of needles per unit area cannot be achieved in the known systems.

As already described above, the extension profile 48 is arranged between the head of the individual perforating needles 16 and blocking slides 22. The extension profile 48 consists, for example, of a hardened round material with a stepped diameter, which rests loosely on the head of the perforating needle 16. The stepped outer diameter prevents any movement of the vertically installed extension profile 48 in the control block 14 during installation or removal of the tool. At the same time, the extension profile 48 is retained in a fixedly defined position above the needle head by this step.

In order to compensate for the difference between the predefined needle diameter or needle spacing and the necessarily wider blocking slide 22 with the associated piston rod 20, these mechanical extension profiles 48 are inserted with different lengths in the control block 14 and assigned accordingly to the blocking slides 22.

The individual piston-cylinder units are present on both sides of the control block 14 as special cylinders and are actuated individually by control valves 26. These special cylinders are arranged within the machine, for example in housings 38 each having four piston-cylinder units, in order to protect them against damage or access. These housings 38 contain the complete electronic and pneumatic actuation system (valve terminals, pressure regulators, pressure monitoring, etc.). These housings 38 are connected by means of a coupling system constructed for this purpose to the valve device 26 with its individually assigned control valves. Alternatively, however, the control valves of the valve device 26 can also be mounted flexibly on appropriate transport frames, in order to use same on different punching machines. As a result, there is no restriction to only one working area.

As a result of the permanently present counter-pressure P1 in the return stroke of the piston rod 20 of the piston-cylinder units, the switching time between the punching operations can be reduced greatly. This results in a substantially higher cycle rate (for example 160 to 180 per minute) of the punching unit compared with the known punching/perforating machines.

Furthermore, a first drive unit 70 and a second drive unit 72 are illustrated, also in highly schematized form, in FIG. 3. These two drive units 70, 72 are actuated and activated or deactivated by the control device 30 prior to each punching/perforation stroke H. The first drive unit 70, which is formed for example as a servomotor, is connected via coupling members (not illustrated in any more detail in FIG. 3) to the material unit/web M. The second drive unit 72, which is formed for example as a servomotor, is likewise connected via coupling members (not illustrated in any more detail in FIG. 3) to the material unit/web M. When the first drive unit 70 is activated by the control device 30 in dependence on the data stored in the memory device 40, the material unit/web M carries out a displacement in the transport direction T to the respectively currently predefined extent. When the second drive unit 72 is activated by the control device 30, the material unit/web M carries out a movement in the transverse direction Q to the respectively currently predefined extent.

By virtue of the fact that the material unit/web M can be arranged relative to the punching/perforation tool 12 both in the transport direction T and in the transverse direction Q individually for each punching/perforation stroke H, virtually any desired punching/perforation patterns can be generated.

Figure 4:
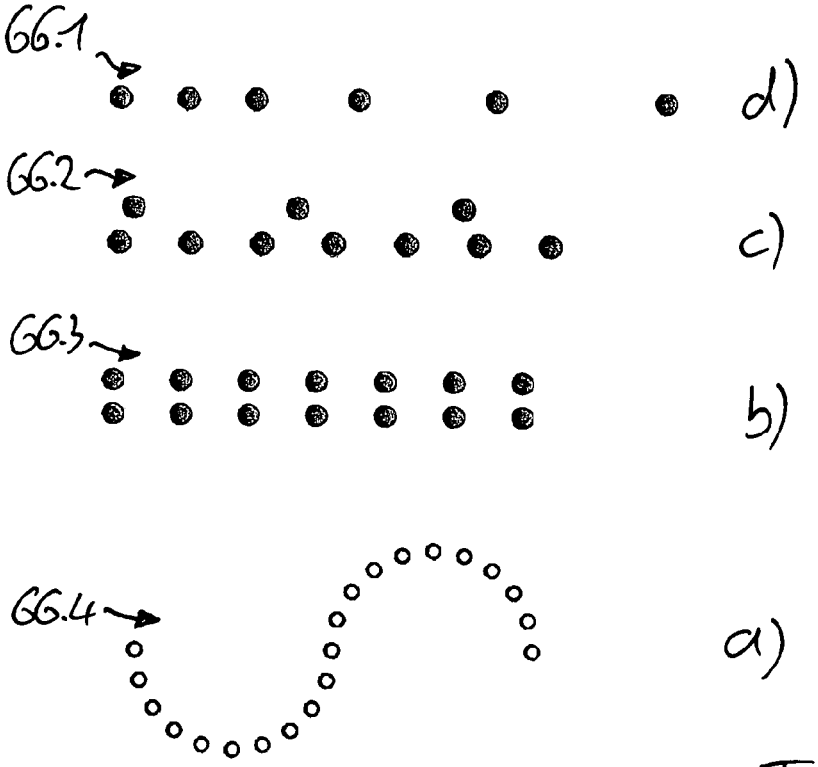
FIGS. 4*a-d* show a schematized illustration of possible punching/perforation patterns using a punching/perforating machine as per FIGS. 1 to 3.

Punching/perforation patterns 66.1, 66.2, 66.3, 66.4 are indicated, by way of example, in FIGS. 4*a, b, c* and *d*. In principle, the displaceability of the material unit/web M makes it possible to place the holes in any desired manner.

Figure 5:
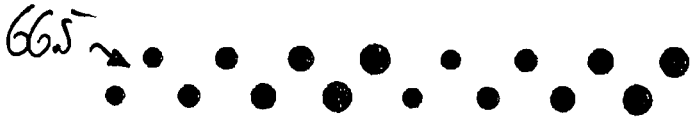
FIG. 5 shows a schematic illustration of a perforation pattern using a punching/perforating machine as per FIGS. 1 to 3 which comprises stamping punches/perforating needles having different hole diameters.

As illustrated in FIG. 5, different hole diameters can also be generated in a hole pattern 66.5 by means of perforating needles 16 of different diameter which are arranged in the punching/perforation tool 12 and by corresponding displacement of the material unit/web M. Prior to the respective punching/perforation stroke H, software is used to determine the perforating needles of corresponding diameter that are closest to the perforation position and to displace the material unit/web M by the corresponding extent.

The mechanical structure of the punching/perforation tool 12 described by way of example makes it possible, as a function of the system, to perform any desired advancing movements in the transport direction T and in the transverse direction Q by coupling the material unit/web M to the first and second drive units 70, 72. As a result, there is, inter alia, the possibility of also producing curved and circular contours 66.4 (see, for example, FIG. 4*a*). Overall, there are virtually unlimited possibilities for the representation of punching/perforation patterns according to any desired design. Examples are the perforation patterns 66.1, 66.2, 66.3 in FIGS. 4*b, c* and *d*. It is necessary merely for the corresponding data files containing the information about the geometry of the punching/perforation pattern, in particular in terms of the position and size, to be read into the memory device 40. Furthermore, the punching/perforation can also be carried out on a material web as roll goods, wherein the complete transport of the material web to be perforated in the transport direction T and in the transverse direction Q is then formed correspondingly in design terms in order to permit this displacement movement.

The invention claimed is:

1. A punching/perforating machine (10) for generating a predefinable punching/perforation pattern in a material unit/web (M) supplied in a transport direction (T), comprising:

a punching/perforation tool (12) having a tool upper part (12.1), which is movable in a stroke direction (H) and which has a plurality of stamping punches/perforating needles (16) which are arranged in a predefined grid in a transverse direction (Q) and which are movable by a pressure beam (36) which is operatively connected via a control device (30) to a drive unit (18) for generating a punching/perforation stroke (H), and a stationary tool lower part (12.2), the stationary tool lower part (12.2) being a female die, wherein the material unit/web (M) is supplied between the tool upper part (12.1) and the stationary tool lower part (12.2), wherein means (70, 72) for generating a simultaneous relative movement of the material unit/web (M) relative to the punching/perforation tool (12) to a predefinable extent both in the transport direction (T) and in the transverse direction (Q) are present, such that the material unit/web (M) is positionable, prior to each punching/perforation stroke (H), in an individual predefinable position relative to the punching/perforation tool (12).

2. The punching/perforating machine as claimed in claim 1, wherein the means (70, 72) comprise a first drive unit (70), which brings about a movement of the material unit/web (M) in the transport direction (T), and a second drive unit (72), which brings about the movement of the material unit/web (M) in the transverse direction.

3. The punching/perforating machine as claimed in claim 2, wherein the first drive unit (70) and the second drive unit (72) are each formed as a servomotor.

4. The punching/perforating machine as claimed in claim 2, wherein the drive units (70, 72) are connected via coupling members to the material unit/web (M).

5. The punching/perforating machine as claimed in claim 1, further comprising a memory device (40), in which data for a geometry of the punching/perforation pattern with respect to position and diameter is stored, wherein the control device (30) is communicatively connected to the memory device (40), wherein the control device (30) is operatively connected to a control block (14) of the stamping punches/perforating needles (16) for actuation/activation/deactivation of the stamping punches/perforating needles (16) during a punching/perforating operation, wherein the control device (30) is communicatively connected to the means (70, 72) for generating a simultaneous relative movement of the material unit/web (M) and wherein the control device (30) initiates the corresponding activation of the means (70, 72) in dependence on the data stored in the memory device (40).

6. The punching/perforating machine as claimed in claim 1, wherein the punching/perforation tool (12) comprises stamping punches/perforating needles (16) having different diameters.

7. The punching/perforating machine as claimed in claim 1, further comprising:

a control block (14), which comprises piston-cylinder units whose movements during the punching/perforation stroke are individually actuable via the control device (30) and are individually assigned to each stamping punch/each perforating needle (16); and a blocking slide (22), which is connected in each case to a corresponding piston rod (20) of the piston-cylinder unit, wherein the blocking slide (22) is displaceable into an activation or deactivation position by the movement of the piston rod (20), wherein, in the activation position, the blocking slide acts directly or indirectly on the stamping punch/the perforating needle (16) during execution of the stroke (H), and wherein, in the deactivation position, the blocking slide does not exert any action on the stamping punch/the perforating needle (16), such that, in the activation position of the blocking slide (22), the blocking slide (22) acts on the stamping punch/perforating needle (16) during the stroke (H) and a perforation is carried out and, in the deactivation position of the blocking slide, no punching/perforation of the material unit/web (M) is effected.

8. The punching/perforating machine as claimed in claim 7, wherein the piston-cylinder unit is formed as a double-acting piston-cylinder unit having a first pressure chamber (28) and a second pressure chamber (32), wherein a first pressure (P1) is applied permanently to the first pressure chamber (28) via the control device (30) and has the effect that the blocking slide (22) is located or retained in the deactivation position and, when carrying out punching or perforation, the control device (30) applies a second pressure (P2), which is higher than the first pressure (P1), to the second pressure chamber (32) when activated, such that the blocking slide (22) moves out into the activation position and, as a result, during the stroke (H), this movement is transmitted to the associated stamping punch/perforating needle, such that punching or perforation of the material unit/web (M) is carried out.

* * * * *